US009878814B2

(12) United States Patent
Geerts et al.

(10) Patent No.: US 9,878,814 B2
(45) Date of Patent: Jan. 30, 2018

(54) APPARATUS FOR PACKAGING AN OBJECT WITH A TUBULAR FILM

(71) Applicant: Erin Intellectual Property Limited, Birr (IE)

(72) Inventors: Kees Geerts, Moergestel (NL); Martijn H. C. De Laat, Veldhoven (NL); Lambertus Johannes Beekmans, Eindhoven (NL)

(73) Assignee: Erin Intellectual Property Limited, Birr, Co Offaly (IE)

( * ) Notice: Subject to any disclaimer, the term of this patent is extended or adjusted under 35 U.S.C. 154(b) by 1004 days.

(21) Appl. No.: 14/182,915

(22) Filed: Feb. 18, 2014

(65) Prior Publication Data

US 2014/0230380 A1 Aug. 21, 2014

(30) Foreign Application Priority Data

Feb. 19, 2013 (EP) ..... 13155818

(51) Int. Cl.

| | |
|---|---|
| ***B65B 59/04*** | (2006.01) |
| ***B65B 47/04*** | (2006.01) |
| ***B65B 9/10*** | (2006.01) |
| ***B65B 9/14*** | (2006.01) |
| ***B65B 9/13*** | (2006.01) |

(52) U.S. Cl.

CPC ..... *B65B 59/04* (2013.01); *B65B 9/10* (2013.01); *B65B 9/13* (2013.01); *B65B 9/135* (2013.01); *B65B 9/14* (2013.01); *B65B 47/04* (2013.01)

(58) Field of Classification Search

CPC .. B65B 9/10; B65B 9/13; B65B 9/135; B65B 9/14; B65B 59/04

USPC ..... 53/459, 567, 393

See application file for complete search history.

(56) References Cited

U.S. PATENT DOCUMENTS

| | | | | |
|---|---|---|---|---|
| 2,797,634 | A * | 7/1957 | Rueckert | A22C 11/005 100/13 |
| 4,936,080 | A * | 6/1990 | Haloila | B65B 11/025 53/176 |
| 6,298,636 | B1 * | 10/2001 | Lachenmeier et al. | |
| 7,036,289 | B2 * | 5/2006 | Suolahti | B65B 11/025 53/201 |
| 2004/0083690 | A1 * | 5/2004 | Gambetti | B65B 11/10 53/498 |
| 2006/0236656 | A1 * | 10/2006 | Bausch | B65B 59/04 53/167 |

(Continued)

FOREIGN PATENT DOCUMENTS

| | | | | |
|---|---|---|---|---|
| DE | 102010025609 | A1 * | 1/2012 | |
| EP | 1574433 | A1 * | 9/2005 | B65B 9/135 |

(Continued)

*Primary Examiner* — Hemant M Desai
*Assistant Examiner* — Mobeen Ahmed
(74) *Attorney, Agent, or Firm* — The Webb Law Firm

(57) ABSTRACT

An apparatus for packaging an object with a tubular film, includes: a main frame, a stretch frame for stretching the tubular film and for applying the tubular film to the object, and a top frame having a feeding device for delivering a tubular film from a film magazine to the stretch frame and having a cutting device to cut the tubular film to a predetermined length. The top frame is moveable at the main frame between a working position and a maintenance position. In the maintenance position the top frame is located outside the work space.

11 Claims, 3 Drawing Sheets

(56) References Cited

U.S. PATENT DOCUMENTS

| | | | | |
|---|---|---|---|---|
| 2009/0272080 | A1* | 11/2009 | Lachenmeier | B65B 9/135 53/461 |
| 2013/0133290 | A1* | 5/2013 | Tebeck | B65B 9/135 53/450 |
| 2014/0013707 | A1* | 1/2014 | Murarotto | B65B 11/045 53/203 |
| 2014/0250831 | A1* | 9/2014 | Suolahti | B65B 11/025 53/203 |

FOREIGN PATENT DOCUMENTS

| | | | | |
|---|---|---|---|---|
| EP | 2069206 | B1 | 1/2010 | |
| EP | 2336034 | B1 * | 1/2013 | B65B 9/135 |
| EP | 2594489 | * | 5/2013 | B65B 11/54 |
| WO | 2008031449 | A1 | 3/2008 | |

* cited by examiner

APPARATUS FOR PACKAGING AN OBJECT WITH A TUBULAR FILM

CROSS-REFERENCE TO RELATED APPLICATION

This application claims priority to European Patent Application No. 13155818.1-1708 filed Feb. 19, 2013, the disclosure of which is hereby incorporated by reference in its entirety.

BACKGROUND OF THE INVENTION

Field of the Invention

The invention relates to an apparatus for packaging an object with a tubular film, the apparatus comprising a main frame, a stretch frame for stretching the tubular film and to applying the tubular film to the object, and a top frame having a feeding device for delivering a tubular film from a film magazine to the stretch frame and having a cutting device to cut the tubular film to a predetermined length, wherein the top frame is moveable at the main frame between a working position and a maintenance position.

Such an apparatus is basically used as a universal applicable pallet load securing system based on stretch hood technology to secure a large range of stacked loads to a pallet. The system guarantees optimum product safety by protecting it against humidity, UV radiation and other weather conditions as well as against the danger of cargo shift during transport.

Description of Related Art

Such an apparatus is known from EP 2 069 206 B1 for packaging objects, in particular stacks of goods which are arranged on a pallet. The tubular film is delivered by the feeding device of the top frame from a film roll. The top frame is located on top of the main frame and delivers the tubular film from the film roll which is arranged beside the main frame. Hence, the tubular film is pulled up to the top frame by the feeding device and is supplied to a work space of the main frame underneath the top frame. The tubular film is cut and sealed by a combined cutting and sealing device to form a film hood which can be arranged over the stack of goods. The film hood protects the goods from external influences and gives increased stability to the stack. The film hood is grasped by a gripper device of the stretch frame, opened and stretched. Subsequently, the opened film hood is pulled downwardly over the stack of goods. Finally, the grippers are pulled out of the film hood so that the film hood completely shrinks over the stack of goods elastically. Alternatively or additionally, the film hood can be shrunk by applying heat to the tubular film. In order to maintain the top frame, especially the feeding device or the cutting device, the top frame can be moved from an upper working position downwardly in a vertical direction for lowering the top frame to a maintenance position within the main frame. Consequently, the maintenance and repair work may be handled in a comfortable position and at a low height. However, the operator or worker has to enter the work space which is generally not preferably because the work space is generally a dangerous area for workers.

U.S. Pat. No. 6,298,636 B1 discloses a comparable apparatus wherein for maintenance reasons a gantry is provided on top of the main frame so that an operator can access the devices of the top frame. The top frame is fixed to the main frame and cannot be moved relative to the main frame.

The object of the invention is to provide an apparatus which is easy to maintain without exposing an operator to a dangerous situation.

SUMMARY OF THE INVENTION

The object is solved by an apparatus for packaging an object with a tubular film, the apparatus comprising a main frame, a stretch frame for stretching the tubular film and to applying the tubular film to the object, and a top frame having a feeding device for delivering a tubular film from a film magazine to the stretch frame and having a cutting device to cut the tubular film to a predetermined length, wherein the top frame is moveable at the main frame between a working position and a maintenance position, wherein in the maintenance position the top frame is at least substantially located outside the work space.

The main advantage of the present invention is that the top frame can be moved from a working position, to a maintenance position latter being at least substantially, preferably completely, outside the work space. At least substantially outside the work space means, that the top frame is moved to a position outside the work space in such an extend that an operator can access the devices mounted to the top frame from outside the work space. The operator has not to enter the work space in order to maintain the devices mounted to the top frame or to insert a new tubular film. The top frame is not fixed to the main frame nor is it a fixed part of it. During the working operation of the apparatus the top frame is maintained in a working position above a work space. For maintenance of the equipment, which is located at the top frame, and for applying a new tubular film to the top frame the top frame can be moved to its maintenance position, in which the top frame is easily accessible for an operator.

In the maintenance position the top frame is in a lower position accessible for maintenance from outside the work space. For this reason the top frame, in its maintenance position, is moved outside the work space. Preferably, the top frame is positioned adjacent to the main frame. In the maintenance position the top frame can be orientated substantially vertical so that rolls or the like for conveying the tubular film can be accessed easily by an operator standing in front of the vertical orientated top frame. In order to achieve this the top frame is tilted about an axis by approximately 90 degrees.

In the maintenance position the top frame may be arranged at the same side of the main frame as a film magazine, which film magazine receives a film roll. Preferably, the maintenance space for personnel is arranged between the film magazine and the top frame in its maintenance position.

In order to move the top frame between the working position and the maintenance position the apparatus further comprises a hoist device. The hoist device preferably comprises a motor being attached to the main frame or to the top frame. The hoist device may comprise a belt or chain. When the motor is attached to the main frame the belt or chain is coupled to the top frame and is driven by the motor. Hence, the top frame follows the movement of the belt or chain. Alternatively, if the motor is attached to the top frame the belt or chain is stationary with the main frame, i.e. the belt or chain is coupled or fixed to the main frame, so that the top frame moves along a stationary belt or chain driven by the motor.

The hoist device comprises guiding means for guiding the top frame while being moved. The guiding means may comprise two guide tracks at the main frame each adjacent to one side of the top frame. The top frame has track rollers being guided within the guide tracks.

Each of the guide tracks may have a horizontal section for receiving the top frame in its working position and a vertical section for receiving the top frame in its maintenance position, wherein the vertical section of each of the guide tracks is outside the work space.

Preferably, in the working position the top frame is in an upper position above a work space in which the object to be packaged is to be arranged and in the maintenance position the top frame is in a lower position, preferably on floor level accessible for an operator standing on the floor. The main frame may comprise four posts each located at one edge of the work space. At the top of the posts the posts are connected to each other by a rectangular supporting frame. The work space is basically defined by the four posts and the support frame. The top frame in its working position is positioned in the area of the support frame preferably right below the support frame. The top frame can be made of longitudinal profiles arranged in a rectangular manner wherein in the working position the top frame and the support frame are parallel to each other and are orientated substantially horizontal.

For pulling the tubular film over the object to be packaged the stretch frame is moveable at the main frame in a vertical direction. Further, in order to move the top frame from its working position to its maintenance position it might be necessary to move the stretch frame from an upper position to an intermediate position in order to have enough space for the top frame to be move downwardly and to be tilted from the horizontal upper working position to the vertical lower maintenance position.

Preferred embodiments are described in more detail with reference to the attached drawings.

DESCRIPTION OF THE INVENTION

Figure 1:
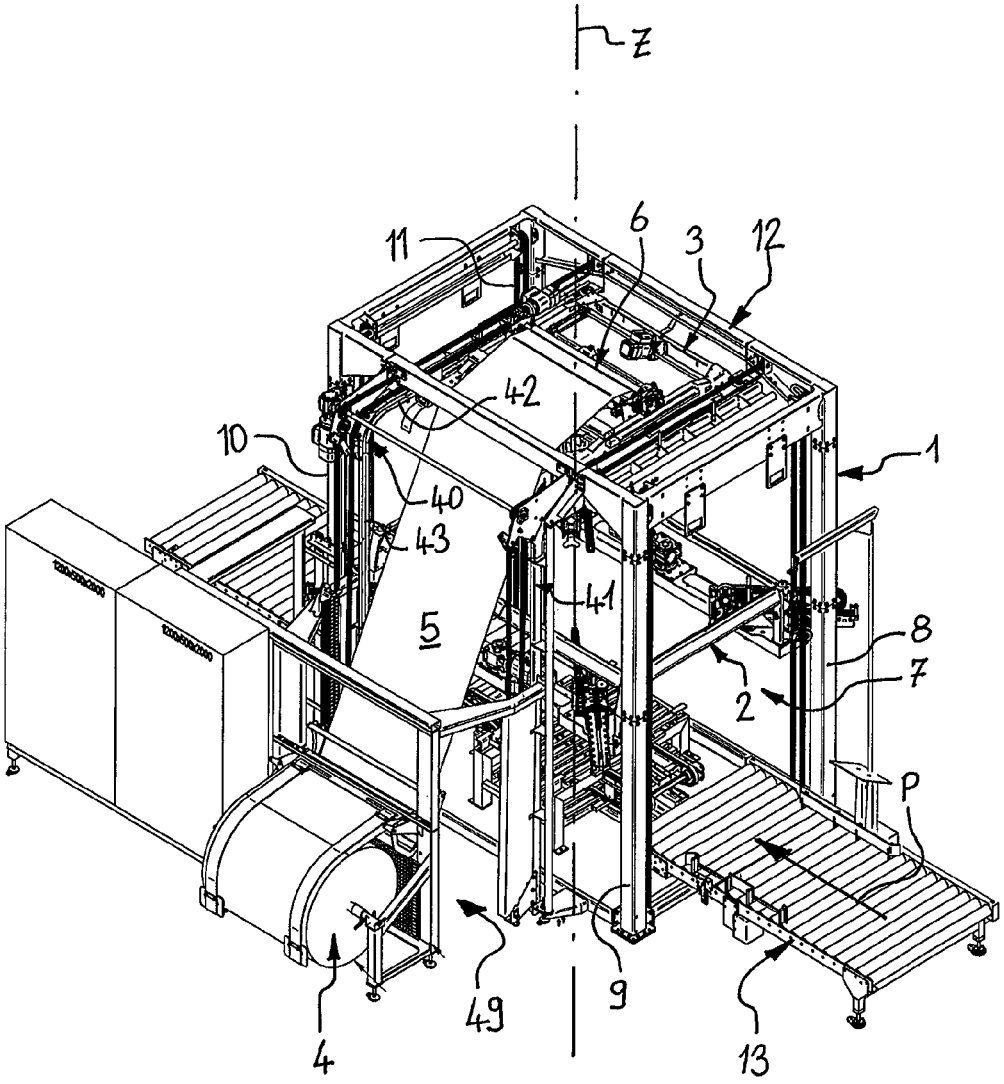
FIG. 1 is a perspective view of an apparatus for packaging an object with the top frame in its working position.
Figure 2:
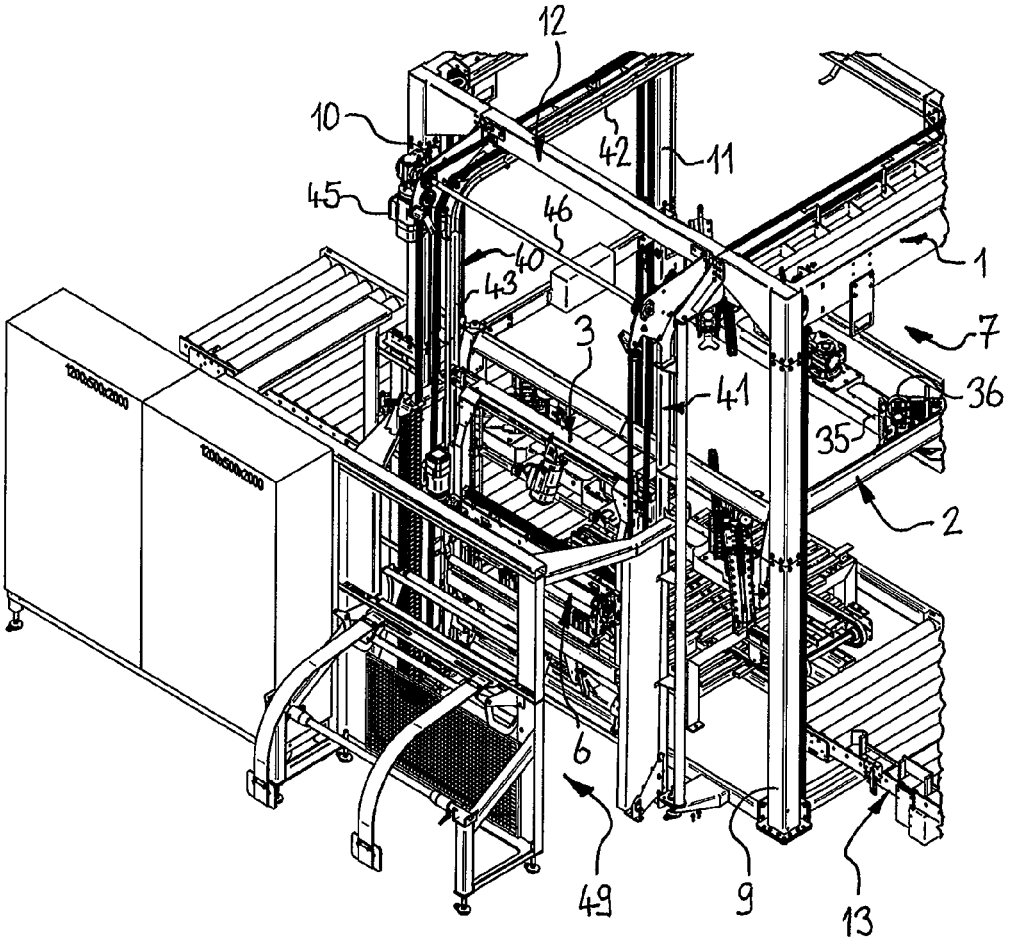
FIG. 2 is an enlarged view of the apparatus according to FIG. 1 with the top frame being in a maintenance position.
Figure 4:
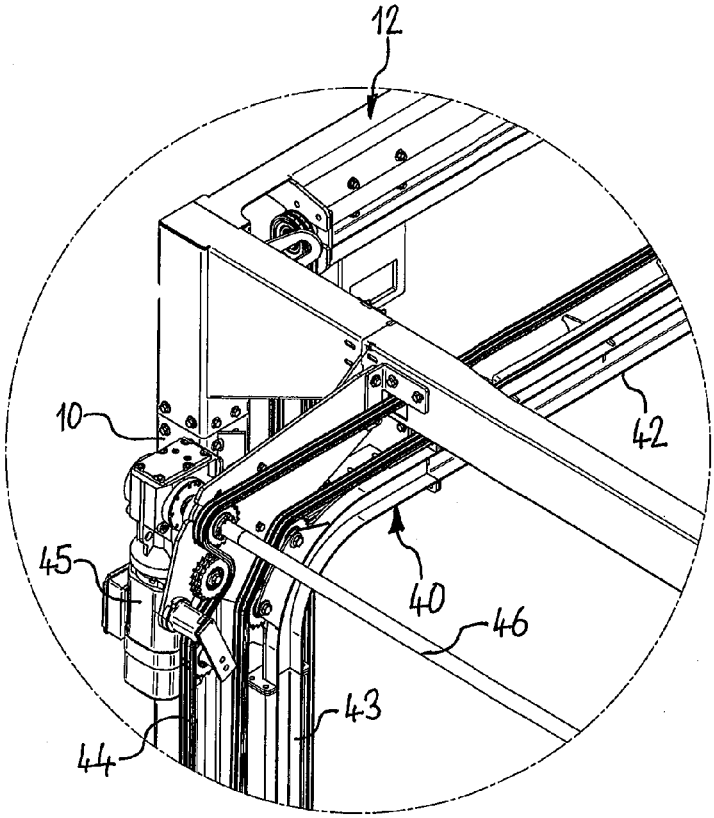
FIG. 4 is an enlarged detailed view of the hoist device for moving the top frame.

The apparatus according to FIG. 1 is used for packaging objects or stacks of goods arranged on a pallet (not shown). The apparatus comprises a main frame 1 which stands on the ground and defining a work space 7. A stretch frame 2 is guided at the main frame 1 and can be moved up and down in the direction of a vertical axis Z. Further, a top frame 3 is provided which can be moved between a working position as shown in FIG. 1 and a maintenance position as shown in FIG. 2. On the ground and adjacent to the main frame 1 the apparatus comprises a film magazine 4 for receiving a film roll 50. From the film magazine 4 a tubular film 5 of the film roll 50 is guided to the top frame 3, wherein at the top frame 3 there is a feeding device 6 for supplying the tubular film 5 from the top into the work space 7.

The main frame 1 has four vertical posts 8, 9, 10, 11 which are parallel to the vertical axis Z. At a top end the posts 8, 9, 10, 11 are connected to each other via a support frame 12 which has a rectangular form and which is orientated horizontal. The work space 7 is basically defined by the posts 8, 9, 10, 11 and the support frame 12 wherein the work space 7 is the space enclosed by the posts 8, 9, 10, 11 and the support frame 12 and the ground.

The apparatus further comprises a pallet conveyor system 13 for conveying pallets with stacked objects (not shown) through the work space 7 of the main frame 1. For this purpose the pallet conveyor system 13 reaches from a first side of the main frame between two of the posts 8, 9 into the work space 7 and between the two other posts 10, 11 out of the work space 7. Accordingly, a pallet can be moved into the work space 7 on a first side of the main frame 1 and can be moved out of the work space 7 on an opposite second side of the main frame 1 in the conveying direction P.

Figure 3:
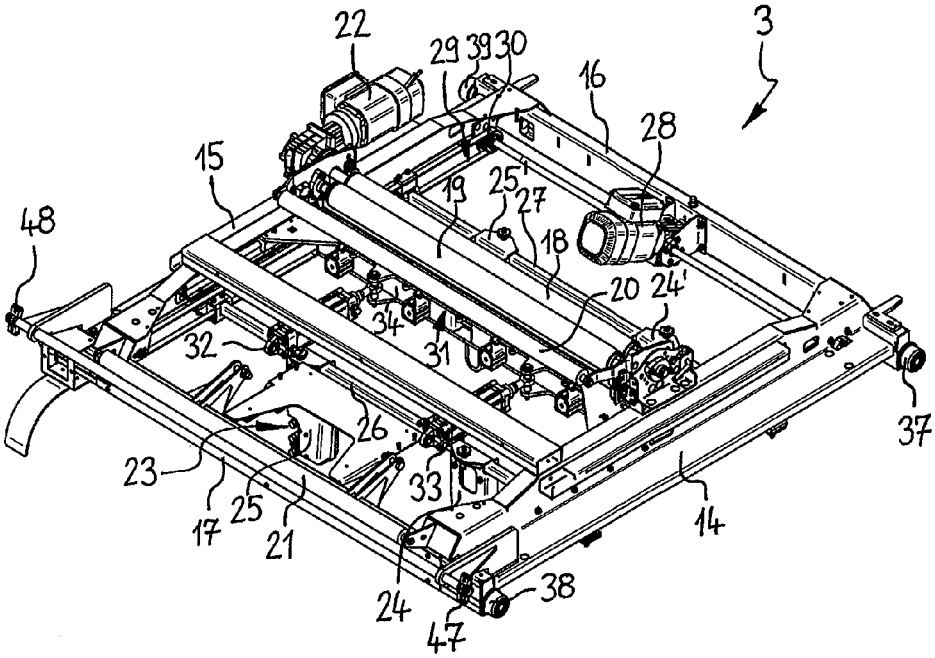
FIG. 3 is a perspective view of the top frame.

The top frame 3 is now described in a detail with reference to FIG. 3. The top frame 3 has a generally rectangular form and is orientated substantially horizontal when in the working position (FIG. 1). The top frame 3 has two parallel side bars 14, 15 (longitudinal profiles) and two parallel front bars 16, 17 (longitudinal profiles) which together form a rectangular frame. The feeding device 6 reaches the two side bars 14, 15 and is fixed to the side bars 14, 15 and is arranged parallel to the front bars 16, 17 between them. The feeding device 6 comprises two feeding rolls 18, 19 which are driven by a feeding motor 22. The tubular film can be inserted between the two feeding rolls 18, 19 clamping the tubular film between the feeding rolls 18, 19 so that by driving the feeding rolls 18, 19 in opposite rotational directions the tubular film can be fed from above the feeding device 6 downwardly into the work space 7 below the top frame 3.

The feeding device 6 further comprises two guiding rolls 20, 21 for guiding the tubular film from the film magazine upwardly passing the top frame 3 at one of the front bars 17 to the area above the top frame then in direction towards the feeding rolls 18, 19.

The top frame 3 further comprises an opening device 23 for opening the flattened tubular film 5. The opening device 23 is arranged below the feeding device 6 and has two pairs of holding elements 24, 24', 25, 25'. The holding elements 24, 24', 25, 25' are moveable parallel to the side bars 14, 15. The holding elements 24, 24', 25, 25' of each pair can be moved in opposite longitudinal directions. The holding elements 24, 24', 25, 25' of each pair are arranged on different bars, namely a first bar 26 and a second bar 27, which bars 26, 27 can be moved in opposite directions. The bars 26, 27 are driven by a motor 28 which drives two belt drives 29 arranged adjacent to the side bars 14, 15. The first bar 26 and the second bar 27 are connected to a belt 30 of the belt drive 29 in such a way that the bars 26, 27 are moved in opposite directions when the belt 30 is driven by the motor 28. Hence, the holding elements 24, 24', 25, 25' of each pair can be opened and closed. First, the holding elements 24, 24', 25, 25' are opened while the tubular film 5 is conveyed through the feeding rolls 18, 19 downwardly into the work space 7 and between the holding elements 24, 24', 25, 25'. Afterwards, the holding elements 24, 24', 25, 25' are closed and the holding elements are actuated such that they get hold of a layer of the tubular film. By opening the holding elements 24, 24', 25, 25' the layers of the tubular film is attached to the holding elements and the tube is opened.

For cutting and sealing the tubular film 5 the top frame 3 comprises a cutting and sealing device 31 having two cutting and sealing bars, one of which can be seen in FIG. 3. The cutting and sealing bars 34 are parallel to the front bars 16, 17 of the top frame 3 and can be moved parallel to the side bars 14, 15. When conveying the tubular film 5 downwardly from the feeding device 6 the cutting and sealing device 31 is open, i.e. the cutting and sealing bars 34 are moved apart. After a predetermined amount of tubular film has been conveyed downwardly the cutting and sealing bars 34 are moved towards each other so that the cutting and sealing device 31 is closed. Then, heat is applied to the tubular film 5 via the cutting and sealing bars 34 in order to cut the tubular film 5 and to seal it to form a hood which is closed at the top end. This hood then can be pulled over the objects on the pallet.

After the tubular film 5 has been opened by the opening device 23 grippers 35 which are arranged on the stretch frame 2 (FIG. 1) are moved into the opened tubular film 5 from below. Four grippers 35 are arranged on the stretch frame 2, one at each edge, i.e. one at each post 8, 9, 10, 11 of the main frame 1. After inserting the grippers 35 into the opened tubular film 5 the grippers 35 are moved apart stretching the tubular film 5. Therefore, the grippers 35 are moved towards the respective post 8, 9, 10, 11. Then rollers 36, associated to each of the grippers 35, are pulling down a predetermined amount of tubular film 5. Then, the tubular film 5 is cut and sealed by the aforementioned cutting and sealing device of the top frame 3. Then, the stretch frame 2 is moved downwardly in the direction of the vertical axis Z in order to pull the tubular film 5 in form of a hood over the object to be packaged.

For moving the top frame 3 four track rollers 37, 38, 39 are provided (three of which are shown in FIG. 3). At each edge of the top frame 3 one of the track rollers 37, 38, 39 is arranged. The track rollers 37, 38, 39 are rotatably connected to the side bars 14 wherein the track rollers 37, 38, 39 of each side bar 14, 15 are orientated to rotate about parallel axes. The track rollers 37, 38, 39 project from the respective side bar 14, 15 so that they can be guided in a guiding device having guide tracks 40, 41 of a hoist device which guide tracks 40, 41 are mounted to the main frame 1.

The guide tracks 40, 41 are made of profiled rails having a U-shaped cross section. The openings of the U-shaped cross sections are facing each other and facing the top frame 3 so that the track rollers 37, 38, 39 can enter the guide tracks 40, 41 to be guided therein. The guide tracks 40, 41 are parallel to each other. Each of the guide tracks 40, 41 has a horizontal section 42 (orientated at least substantially horizontal) which continuous into a vertical section 43. The horizontal sections 42 (orientated at least substantially horizontal) of the guide tracks 40, 41 are located right below the support frame 12 of the main frame 1 in the upper part of the main frame 1. In the working position of the top frame 3 the track rollers 37, 38, 39 are arranged in the horizontal sections 42 of the guide tracks 40, 41.

The vertical sections 43 of the guide tracks 40, 41 are located outside of the work space 7 adjacent to the main frame 1 on the side of the film magazine 4 of the main frame 1. The vertical sections 43 of the guide tracks 40, 41, hence, are located between the main frame 1 and the film magazine 4 and receive the top frame 3 in its maintenance position.

A chain 44 is associated to each of the guide tracks 40, 41. The chain 44 is arranged in an endless loop substantially parallel to the respective guiding track 40, 41. Both chains 44 are driven by a motor 45 wherein the motor directly drives one of the chains 44 and drives the other chain (not shown) via a shaft 46.

The top frame 3 is provided with attachment devices 47, 48 for coupling the top frame 3 with the chains 44.

Adjacent the main frame 1 between the guiding tracks 40, 41 and the film magazine 4 there is provided a maintenance space accessible for personnel for maintaining the top frame or to insert a new tubular film to the feeding device 6 of the top frame 3.

REFERENCE NUMERALS

1 main frame
2 stretch frame
3 top frame
4 film magazine
5 tubular film
6 feeding device
7 work space
8 post
9 post
10 post
11 post
12 support frame
13 pallet conveyor system
14 side bar
15 side bar
16 front bar
17 front bar
18 feeding roll
19 feeding roll
20 guide roll
21 guide roll
22 feeding motor
23 opening device
24 holding element
25 holding element
26 first bar
27 second bar
28 motor
29 belt drive
30 belt
31 cutting and sealing device
32 drive
33 drive
34 cutting and sealing bar
35 gripper
36 roller
37 track roller
38 track roller
39 track roller
40 guide track
41 guide track
42 horizontal section
43 vertical section
44 chain
45 motor
46 shaft
47 attachment device
48 attachment device
49 maintenance space
50 film roll
P conveying direction
Z vertical axis

What is claimed is:

1. An apparatus for packaging an object with a tubular film, the apparatus comprising:

a main frame, a stretch frame for stretching the tubular film and for applying the tubular film to the object, and a top frame having a feeding device for delivering a tubular film from a film magazine to the stretch frame and having a cutting device to cut the tubular film to a predetermined length, wherein the top frame is moveable along two guide tracks at the main frame, each of the guide tracks adjacent to one side of the top frame, between a horizontal working position and a vertical maintenance position, wherein in the maintenance position the top frame is at least substantially located outside a work space.

2. The apparatus according to claim 1, wherein in the working position the top frame is in an upper position above the work space in which the object to be packaged is to be arranged and that in the maintenance position the top frame is in a lower position accessible for an operator.

3. The apparatus according to claim 1, wherein in the working position the top frame is orientated horizontally and in the maintenance position the top frame is orientated vertically.

4. The apparatus according to claim 1, wherein in the maintenance position the top frame is arranged at the same side of the main frame as the film magazine.

5. The apparatus according to claim 1, wherein a maintenance space for personnel is arranged between the film magazine and the top frame in its maintenance position.

6. The apparatus according to claim 1, wherein the apparatus further comprises a hoist device for moving the top frame.

7. The apparatus according to claim 6, wherein the hoist device comprises a motor being attached to the main frame or to the top frame.

8. The apparatus according to claim 6, wherein the hoist device comprises a belt or chain to which the top frame is coupled or along which the top frame is moved.

9. The apparatus according to claim 6, wherein the hoist device moves the top frame along the two guide tracks between the horizontal working section and the vertical maintenance section.

10. The apparatus according to claim 1, wherein the stretch frame is moveable at the main frame in a vertical direction.

11. The apparatus according to claim 2, wherein the maintenance position of the top frame is at floor level.

* * * * *